US005381319A

United States Patent [19]

Shiao

[11] Patent Number: 5,381,319

[45] Date of Patent: Jan. 10, 1995

[54] TELESCOPIC SHAFT MAGNETIC RETRIEVER WITH ILLUMINATING MEANS

[76] Inventor: Hsuan-Sen Shiao, No. 15-1, Alley 369, Min-Chuan Rd., Taichung City, Taiwan, Prov. of China

[21] Appl. No.: 222,239

[22] Filed: Apr. 4, 1994

[51] Int. Cl.[6] ..... F21V 33/00

[52] U.S. Cl. ..... 362/120; 362/109; 362/119; 362/398; 294/63.5; 135/910

[58] Field of Search ..... 362/102, 109, 119, 120, 362/157, 190, 253, 398; 294/65.5; 135/910, 75; 7/901

[56] References Cited

U.S. PATENT DOCUMENTS

| | | | |
|---|---|---|---|
| 1,347,382 | 7/1929 | Karro | 294/65.5 |
| 3,384,408 | 5/1968 | Furzey | 294/65.5 |
| 3,582,638 | 6/1971 | Peters | 294/65.5 |
| 3,987,807 | 10/1976 | Varnell | 135/75 |
| 4,819,137 | 4/1989 | Hamilton | 362/102 |

FOREIGN PATENT DOCUMENTS

| | | | |
|---|---|---|---|
| 16597 | of 1908 | United Kingdom | 362/119 |
| 8901747 | 3/1989 | WIPO | 135/75 |

*Primary Examiner*—Ira S. Lazarus
*Assistant Examiner*—Y. Quach
*Attorney, Agent, or Firm*—Bacon & Thomas

[57] ABSTRACT

A telescopic shaft magnetic retriever includes a telescopic shaft having a battery holder at the tip thereof to hold an insulative socket and a battery, a lamp holder fastened to the battery holder to hold a lamp, and a transparent tube fastened to the lamp holder to hold a magnet for retrieving screws, nuts, tools and other steel parts from inaccessible places, and a control rod received inside the telescopic shaft, a spring mounted inside the lamp holder and stopped against the battery at one side, a control rod received inside the telescopic shaft and stopped against the battery at an opposite side, and wherein the battery is electrically connected to the lamp bulb causing it to give light when the telescopic shaft is extended out; the battery is electrically disconnected from the lamp bulb causing it turned off when the telescopic shaft is collapsed.

1 Claim, 6 Drawing Sheets

TELESCOPIC SHAFT MAGNETIC RETRIEVER WITH ILLUMINATING MEANS

BACKGROUND OF THE INVENTION

The present invention relates to magnetic retrievers, and more particularly to a telescopic shaft magnetic retriever which helps retrieve screws, nuts, tools and other steel parts from inaccessible places, and which has an illuminator for illumination when it is extended out for picking up things.

When screws, nuts, tools, or other steel parts are dropped to inaccessible places, a special tool must be used to pick them up. FIG. 1 shows a telescopic shaft magnetic retriever for this purpose. This pickup tool comprises a telescopic shaft having a magnet mounted on the tip thereof. When in use, the telescopic shaft is extended out and then inserted into inaccessible places to retrieve things. However, this pickup tool has no any self-provided lighting device for illumination, and therefore it is difficult to retrieve things from inaccessible places during the dark. In order to eliminate this drawback, there is provided a magnetic retriever with illuminating means which, as shown in FIG. 2, comprises a shaft having one end coupled with a handle and an opposite end mounted with a lamp and covered with a transparent sleeve. The transparent sleeve has a magnet mounted on the front end thereof for retrieving things. The handle comprises a battery on the inside and a control switch on the outside for controlling the operation of the lamp. Because this structure of pickup tool is not telescopic, it is inconvenient to carry.

SUMMARY OF THE INVENTION

The present invention has been accomplished under the aforesaid circumstances. It is therefore one object of the present invention to provide a magnetic retriever which is collapsible. It is another object of the present invention to provide a telescopic shaft magnetic retriever which has a lighting device for illumination. It is still another object of the present invention to provide a telescopic shaft magnetic retriever which automatically turns on the lamp bulb thereof when it is extended out for picking up things. According to one aspect of the present invention, the shaft of the retriever is made telescopic so that the retriever can be collapsed when it is not in use. According to another aspect of the present invention, the battery is received in a battery holder within an insulative socket and stopped between a spring and a control rod. Therefore the battery is electrically connected to the lamp bulb causing it to give light when the telescopic shaft is extended out; the battery is electrically disconnected from the lamp bulb causing it turned off when the telescopic shaft is collapsed.

DETAILED DESCRIPTION OF THE PREFERRED EMBODIMENT

Figure 1:
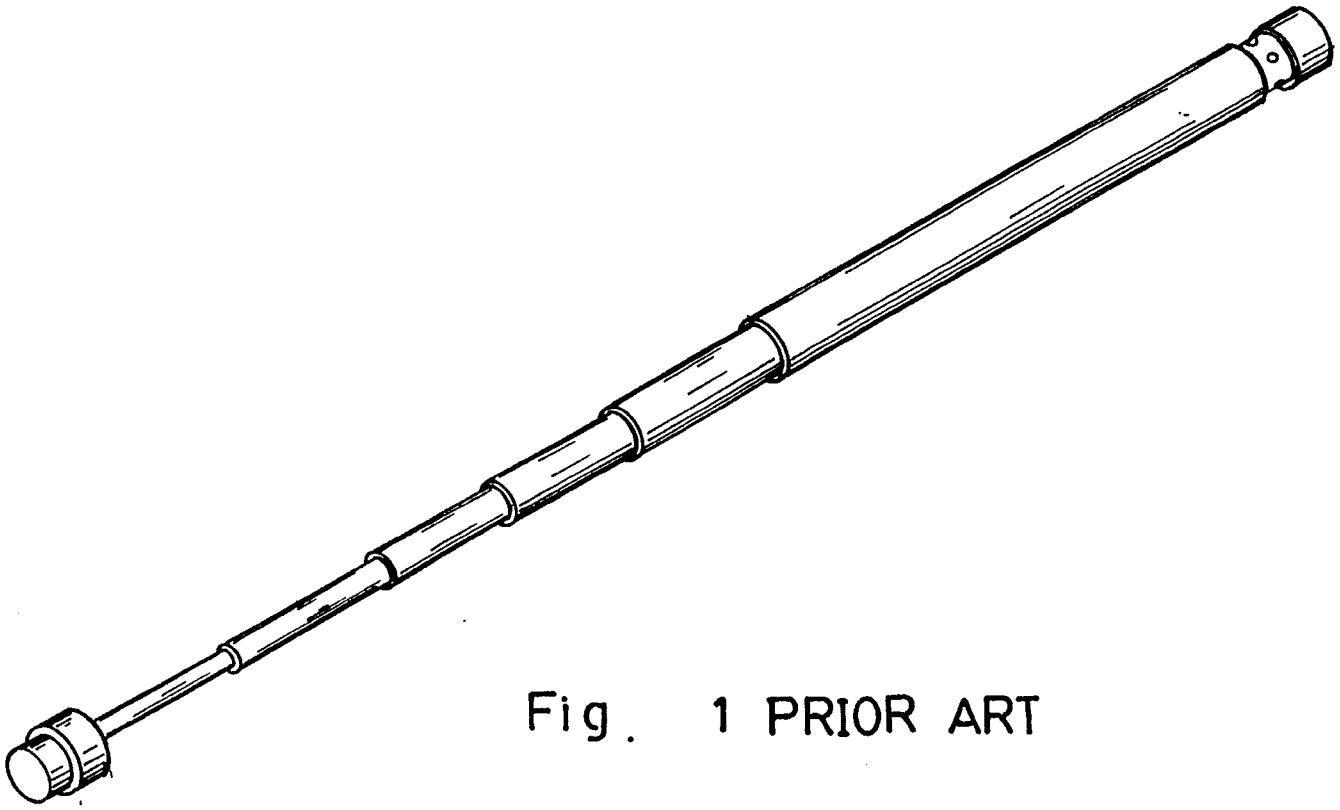
Fig. 1 PRIOR ART
FIG. 1 shows a telescopic shaft magnetic retriever according to the prior art.
Figure 2:
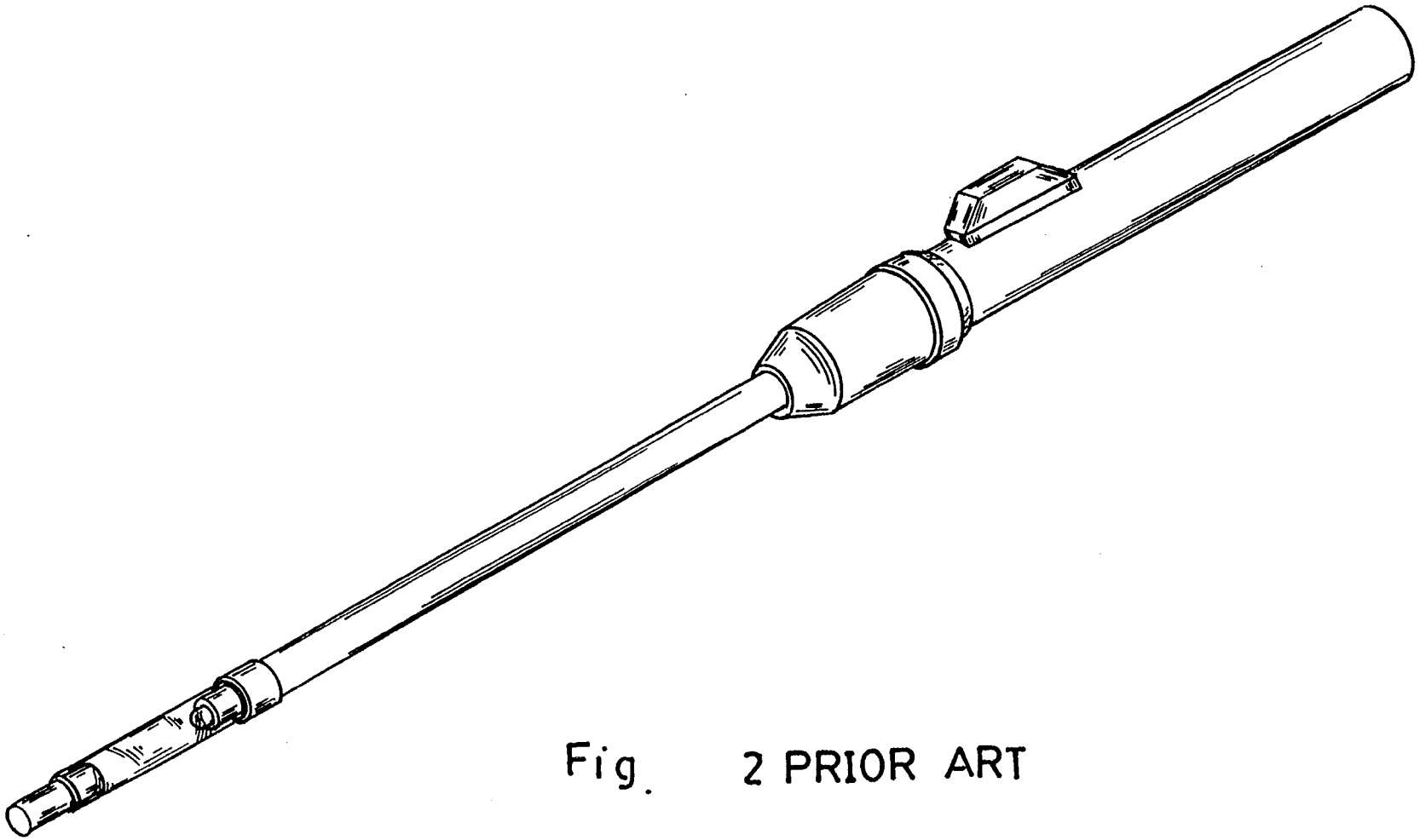
Fig. 2 PRIOR ART
FIG. 2 shows another structure of telescopic shaft magnetic retriever according to the prior art.
Figure 3:
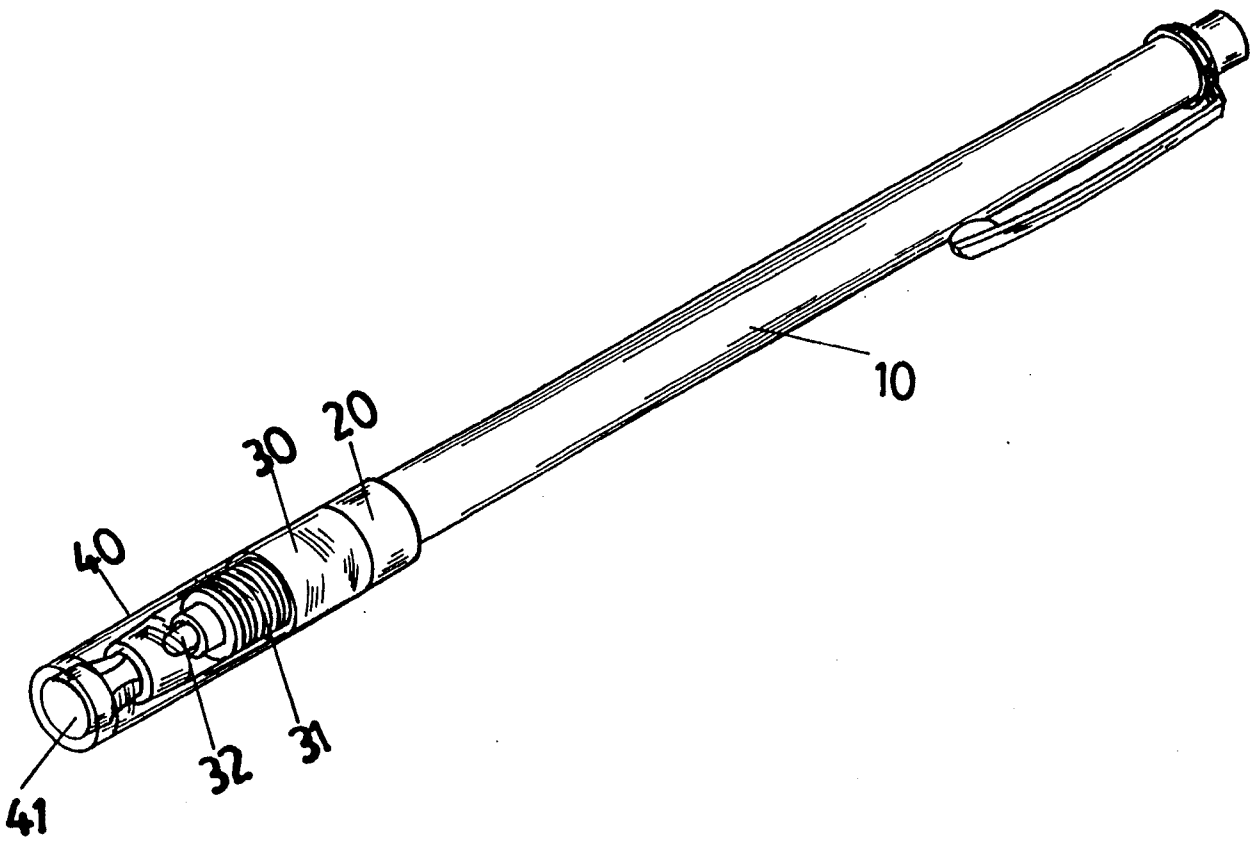
FIG. 3 is a perspective view of a telescopic shaft magnetic retriever according to the preferred embodiment of the present invention.
Figure 4:
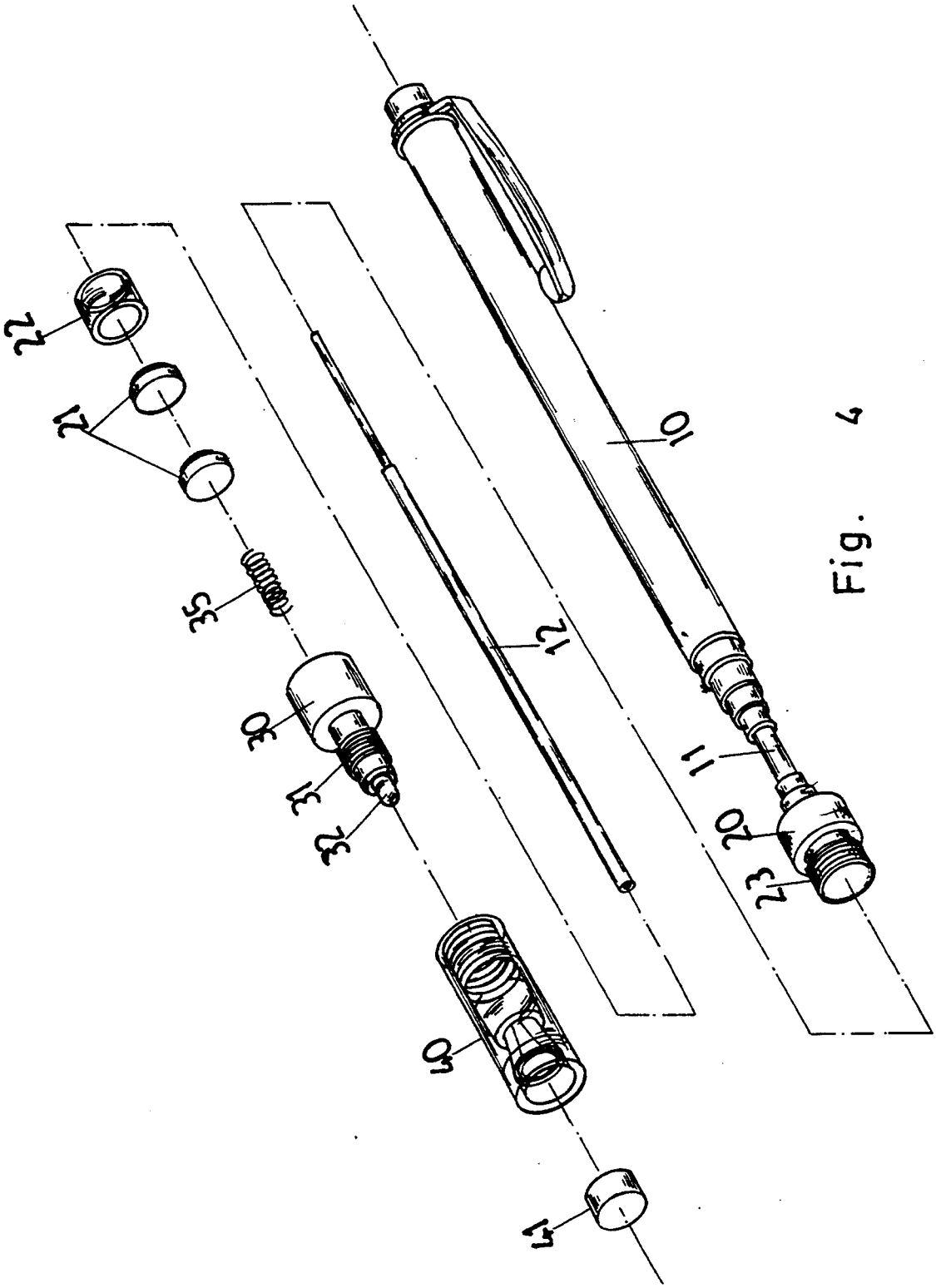
FIG. 4 is an exploded view of the telescopic shaft magnetic retriever shown in FIG. 3.

Referring to FIGS. 3 and 4, the telescopic shaft, referenced by 10, has a tip 11 fastened to a conductive battery holder 20, which holds an insulative socket 22 and a set of dry battery cells 21 inside the insulative socket 22. An insulative control rod 12 is inserted into a longitudinal passage on the telescopic shaft 10 and battery holder 20 and stopped against the set of dry battery cells 21. The battery holder 20 has an outer thread 23 for mounting a lamp holder 30 through a screw joint, permitting the insulative socket 22 and the dry battery cells 21 to be retained between the battery holder 20 and the lamp holder 30 on the inside. The lamp holder 30 comprises an outer thread 31, a central contact metal plate 33 and a side contact metal plate 34. A lamp bulb 32 is fastened to the lamp holder 30 with its ring contact and tip contact respectively disposed in contact with the side contact metal plate 34 and central contact metal plate 33 of the lamp holder 30. A spring 35 is mounted around the central contact metal plate 33 inside the lamp holder 30 and spaced from the side contact metal plate 34. When the lamp holder 30 is fastened to the battery holder 20 tightly, the central contact metal plate 33 is disposed in contact with the positive pole of the dry battery cells 21, and the side contact metal plate 34 is disposed in contact with the inside wall of the battery holder 20. By means of the action of the control rod 12 and the spring 35, the lamp bulb 32 is controlled to give light (this will be explained further). A transparent tube 40 is fastened to the outer thread 31 of the lamp holder 30 through a screw joint, having a magnet 41 fastened to the front end thereof for picking up screws, nuts, tools and other steel parts.

Figure 5:
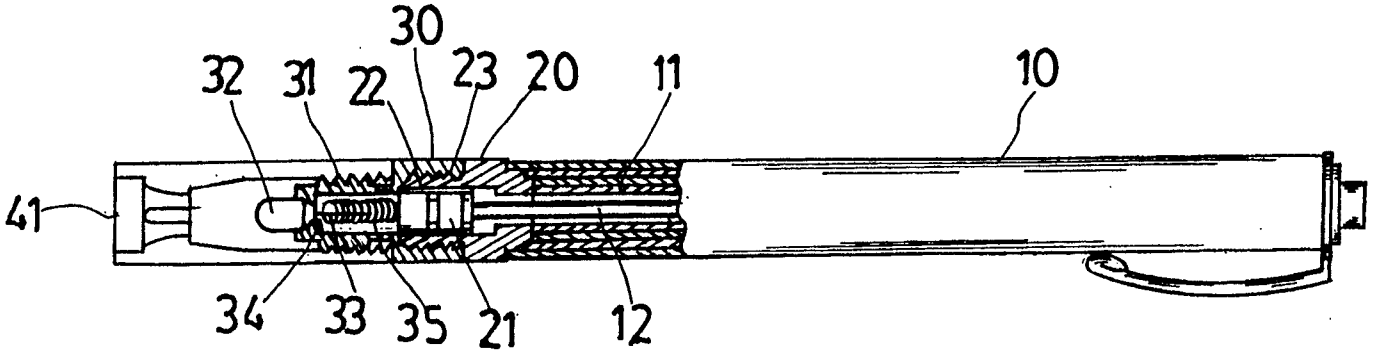
FIG. 5 is a longitudinal view in section of the telescopic shaft magnetic retriever shown in FIG. 3 when collapsed.

Referring to FIG. 5, when the telescopic shaft 10 is collapsed, the dry battery cells 21 is pushed away from the bottom of the battery holder 20 by the control rod 12 to compress the spring 35, the central contact metal plate 33 and the spring 35 are spaced from the side contact metal plates 34 and disposed in contact with the positive pole of the dry battery cells 21, and the side contact metal plate 34 is disposed in contact with the inside wall of the battery holder 20 and insulated from the negative pole of the dry battery cells 21 by the insulative socket 22, and therefore the lamp bulb 32 does no work.

Figure 6:
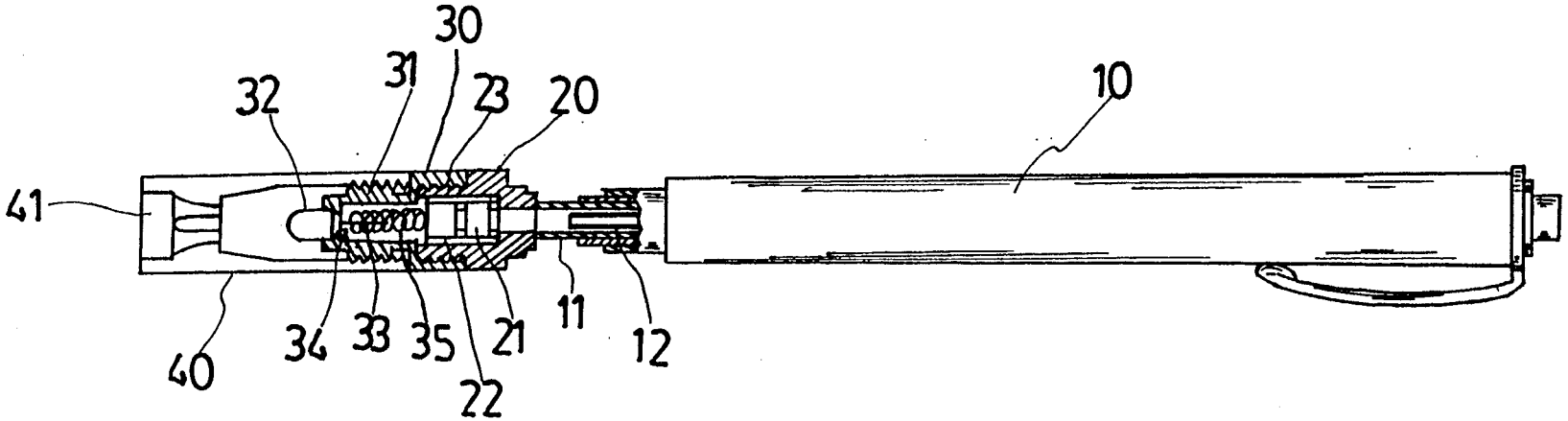
FIG. 6 is similar to FIG. 5 but showing the retriever extended out.

Referring to FIG. 6, when the telescopic shaft 10 is fully extended out, the control rod 12 is released from the dry battery cells 21, causing the spring 35 to push the dry battery cells 21 backwards in contact with the bottom of the battery holder 20, and therefore the side contact metal plate 34 becomes electrically connected to the negative pole of the dry battery cells 21 through the battery holder 20, and the lamp bulb 32 is turned on to give light.

As indicated, when the telescope shaft 10 is extended out for retrieving things, the lamp bulb 32 is automatically turned on to give light for illumination.

While only one embodiment of the present invention has been shown and described, it will be understood that various modifications and changes could be made without departing from the spirit and scope of the invention.

I claim:

1. A telescopic shaft magnetic retriever comprising a telescopic shaft having a conductive battery holder at a tip thereof to hold an insulative socket and a battery set within said insulative socket, a lamp holder fastened to the battery holder to hold a lamp bulb and having a central contact metal plate connected between a tip contact of said lamp bulb and a positive pole of said battery set and a side contact metal plate connected between a ring contact of said lamp bulb and said conductive battery holder, a spring mounted around said central contact metal plate and stopped against the positive pole of said battery set, a transparent tube fastened to said lamp holder to allow passage of light emitted from said lamp bulb and to hold a magnet for retrieving screws, nuts, tools and other steel parts from inaccessible places, and a control rod received in a longitudinal passage inside said telescopic shaft and said conductive battery holder, and wherein a negative pole of said battery set is pushed away from a bottom wall of said conductive battery holder by said control rod causing said battery set electrically disconnected from said lamp bulb when said telescopic shaft is in a retracted position, and said lamp bulb is deactivated; said spring pushes said battery set backwardly toward the bottom wall of the conductive battery holder, when said telescopic shaft is extended out, the negative pole of said battery set contacts the bottom wall of said conductive battery holder again with the control rod maintain within the longitudinal passage of the telescopic shaft, and therefore said battery set is electrically connected to said lamp bulb causing said lamp bulb to activate.

* * * * *